US007540176B2

(12) United States Patent
Arriola Arrizabalaga et al.

(10) Patent No.: US 7,540,176 B2
(45) Date of Patent: Jun. 2, 2009

(54) PROGRAMMABLE ELECTRONICALLY CLOSING LOCK WITH TURN KNOB

(75) Inventors: Pedro Arriola Arrizabalaga, Elgoibar (ES); Iker Badiola Brenaga, Elgoibar (ES); Ana Viso Cabrera, Elgoibar (ES)

(73) Assignee: OJMAR, S.A., Elgoibar, Gipuzkoa (ES)

( * ) Notice: Subject to any disclaimer, the term of this patent is extended or adjusted under 35 U.S.C. 154(b) by 0 days.

(21) Appl. No.: 12/111,761

(22) Filed: Apr. 29, 2008

(65) Prior Publication Data

US 2009/0107192 A1 Apr. 30, 2009

(30) Foreign Application Priority Data

Oct. 25, 2007 (ES) ..... 200702794

(51) Int. Cl.
*E05B 13/00* (2006.01)

(52) U.S. Cl. ..... 70/208; 70/278.7; 70/283; 70/432; 292/144; 292/174; 292/DIG. 37

(58) Field of Classification Search ..... 70/208, 70/278.7, 283, 432, 277, 278.1–278.3, 279.1, 70/283.1; 292/144, 174, DIG. 37
See application file for complete search history.

(56) References Cited

U.S. PATENT DOCUMENTS 1,196,064 A * 8/1916 Zbytniewski et al. ..... 292/170
2,546,703 A * 3/1951 Scanlan ..... 292/170
2,726,889 A * 12/1955 Lawson ..... 292/170
4,167,104 A * 9/1979 Bond ..... 70/208
5,813,257 A * 9/1998 Claghorn et al. ..... 70/208
5,839,304 A * 11/1998 Wills ..... 70/175
6,575,503 B1 * 6/2003 Johansson et al. ..... 292/170
7,194,881 B2 * 3/2007 Kutschat ..... 70/224
2006/0185407 A1 * 8/2006 Priest et al. ..... 70/208
2006/0201214 A1 * 9/2006 Bantle ..... 70/278.7
2006/0248931 A1 * 11/2006 Boulard et al. ..... 70/208
2007/0240463 A1 * 10/2007 Antonucci ..... 70/208

* cited by examiner

*Primary Examiner*—Lloyd A Gall
(74) *Attorney, Agent, or Firm*—Lucas & Mercanti, LLP

(57) ABSTRACT

Programmable electronically closing lock, with knob of the type which incorporates programmed electronic elements which make possible bidirectional communication between lock and key without contact between the two is disclosed. It consists of an electronic board (7) with a microcontroller (17) which controls its opening/closing and communicates with an antenna (8) built into a knob block, made up of a knob (3) joined permanently to a push button/mounting hole piece (5) which has an upper surface (s), lateral slots/guides (13) and a fixed knob guide (4) carrying the antenna (8) and in which the knob (3) moves up and down under the action of a coaxial spring (11) on the knob guide (4) and pins (14) of a tongue block (6) sliding on the slots (13) causing movement in the tongue block. The microcontroller (17) operates a bi-stable solenoid (9).

4 Claims, 4 Drawing Sheets

PROGRAMMABLE ELECTRONICALLY CLOSING LOCK WITH TURN KNOB

The invention involves a programmable electronic lock, especially for locker systems which use transponder technology, in which the movement of the lock tongue is carried out through manual movement of a turn knob located on the front of the door.

Programmable electronically closing locks are already known, with turn knobs with built-in programmed electronic elements which make possible bidirectional communication between lock and key without contact between the two, the lock consisting of an electronic plate with a microcontroller which controls its opening/closing and communicates with an antenna built into a knob block.

In the invention, the turn knob and the tongue are joined through a pushbutton, in such a manner that, on pressing on the turn knob, the tongue protrudes from the lock carcase, the push button and the tongue forming a closed cinematic chain, so that the user knows if the lock is open or closed, simply by observing the position of the push button, as there exists a bi univocal correspondence between the push button and the tongue, which is an advantageous novelty.

Specifically, in the invention the lock consists of:

a) the knob block is made up of a turn knob joined permanently to a push button/mounting hole piece consisting of an upper surface, lateral slots/guides and a fixed-knob guide, carrying an antenna, in which the turn knob moves lineally according to the axis OY against the action of a coaxial spring on the knob guide and b) the tongue block consists of pins which slide in the slots of the push button/mounting hole piece, causing, in the tongue block 6), a movement according to the axis OX;

c) the microcontroller operates a bistable solenoid which consists of a shaft, which, in activated state at the first end, is positioned on the surface of the push button/mounting hole piece, impeding its ascending movement and at the other end, presents a hold-down plate of a contact which indicates to the micro-counter the correct operation of the lock in accordance with programmed logic.

It also offers the advantage of being able to unlock the shaft of the solenoid in case of breakdown, which is achieved through a series of interrelated windows from the head to the base of the turn knob through the fixed knob.

It also offers the advantage of offering to the user the states of the lock through predetermined sequences of times and colours of a led lamp in logical correspondence with said states.

To better understand the purpose of this invention, a practical, preferred method of making it, subject to minor changes which will not fundamentally alter it, is illustrated in the drawings.

Figure 1:
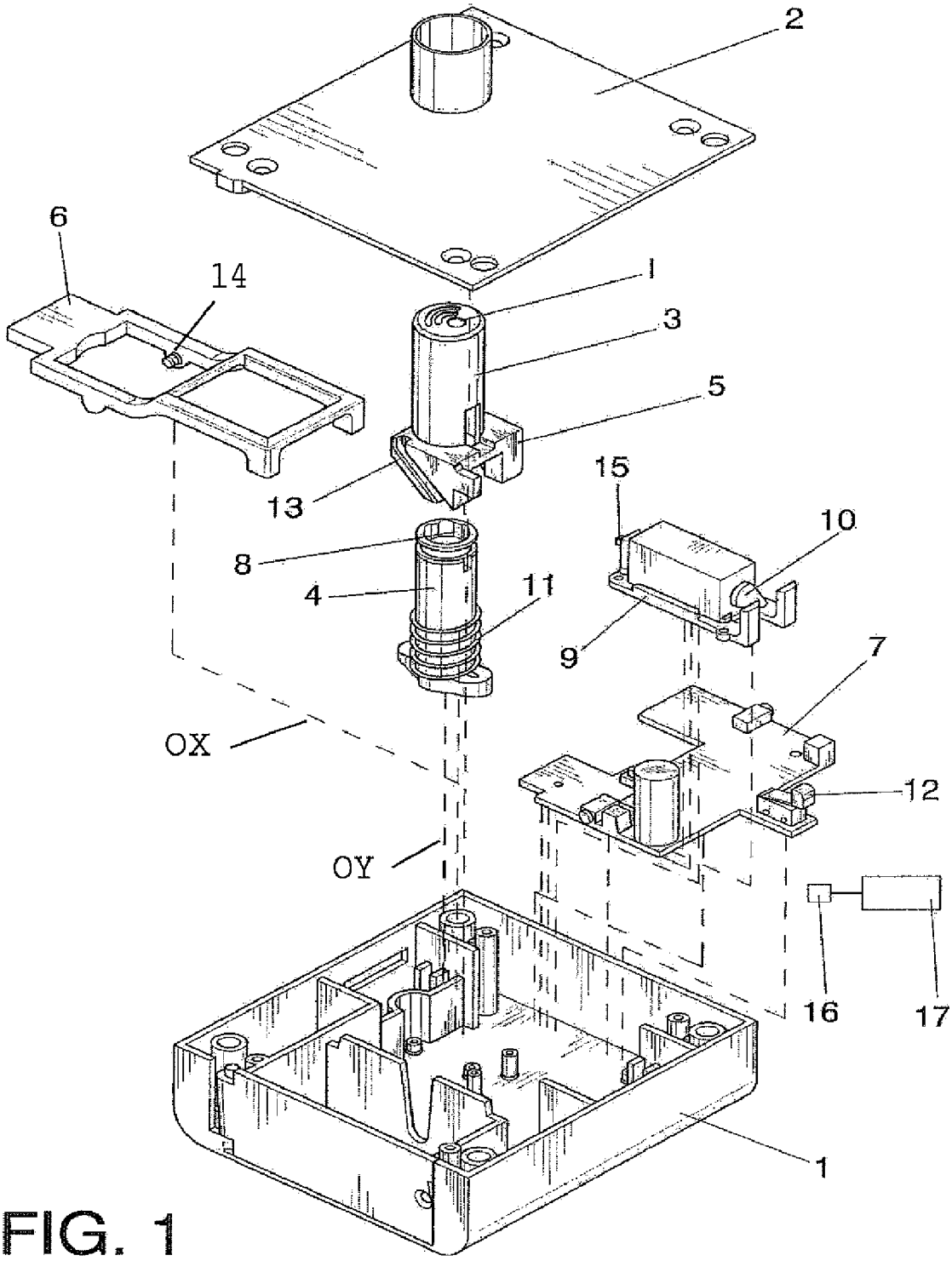
FIG. 1 is a general illustrative diagram of a lock in accordance with the invention, with its components assembled.
Figure 2:
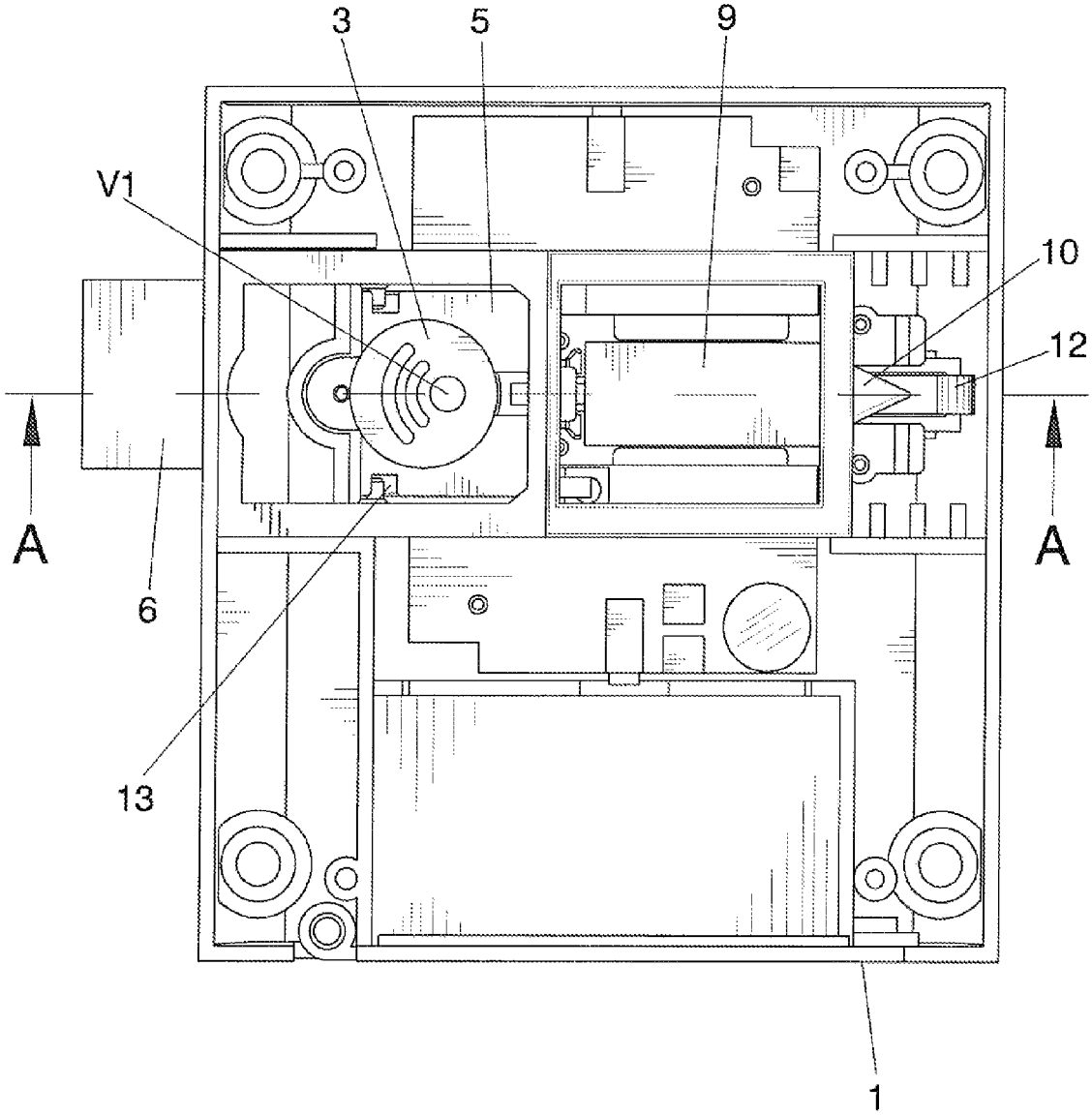
FIG. 2 is a ground plan view with the elements of FIG. 1 already assembled, and with the shaft (15) in locked position.

The following is an example of practical, non-limiting implementation of this invention.

The lock, in accordance with the invention, is composed of the following basic elements:

1—Carcase
2—Cover
3—Turn knob

4—Guide
5—Push button
6—Tongue
7—Electronic board
8—Antenna
9—Solenoid
10—Hold-down plate
11—Spring
12—Detector
13—Guide-slots
14—Pins
15—Shaft
16—Contact
17—Microcontroller The microcontroller (17) which controls the opening/closing of the lock, communicates with the antenna (8), built into the knob block.

The knob block is made up of the turn knob (3) joined permanently to the push button/mounting hole piece (5), and a fixed guide (4), in which the turn knob (3) moves lineally according to the axis OY against the action of the spring (11), mounted coaxially on the knob guide (4).

The push button/mounting hole piece (5) has guide-slots (13).

The tongue block (6) carries pins (14) which slide in the slots (13) of the push button/mounting hole piece (5), causing the tongue block (6) to move according to the axis OX.

The knob block and the tongue block form a closed cinematic chain: the housing of the pins (14) of the tongue (6) in the slots (13) of the push button/mounting hole piece (5) is constant and permanent, so that, on pushing the turn knob (3) and pressing on the mounting hole piece (5) the tongue moves (6) according to axis OX in one direction but on pulling the turn knob (3) the tongue (6) also moves according to the axis OX in the other direction.

The solenoid (9) and elements associated to it are arranged on an electronic board (7) with detector (12)—see FIG. 1—.

Figure 3:
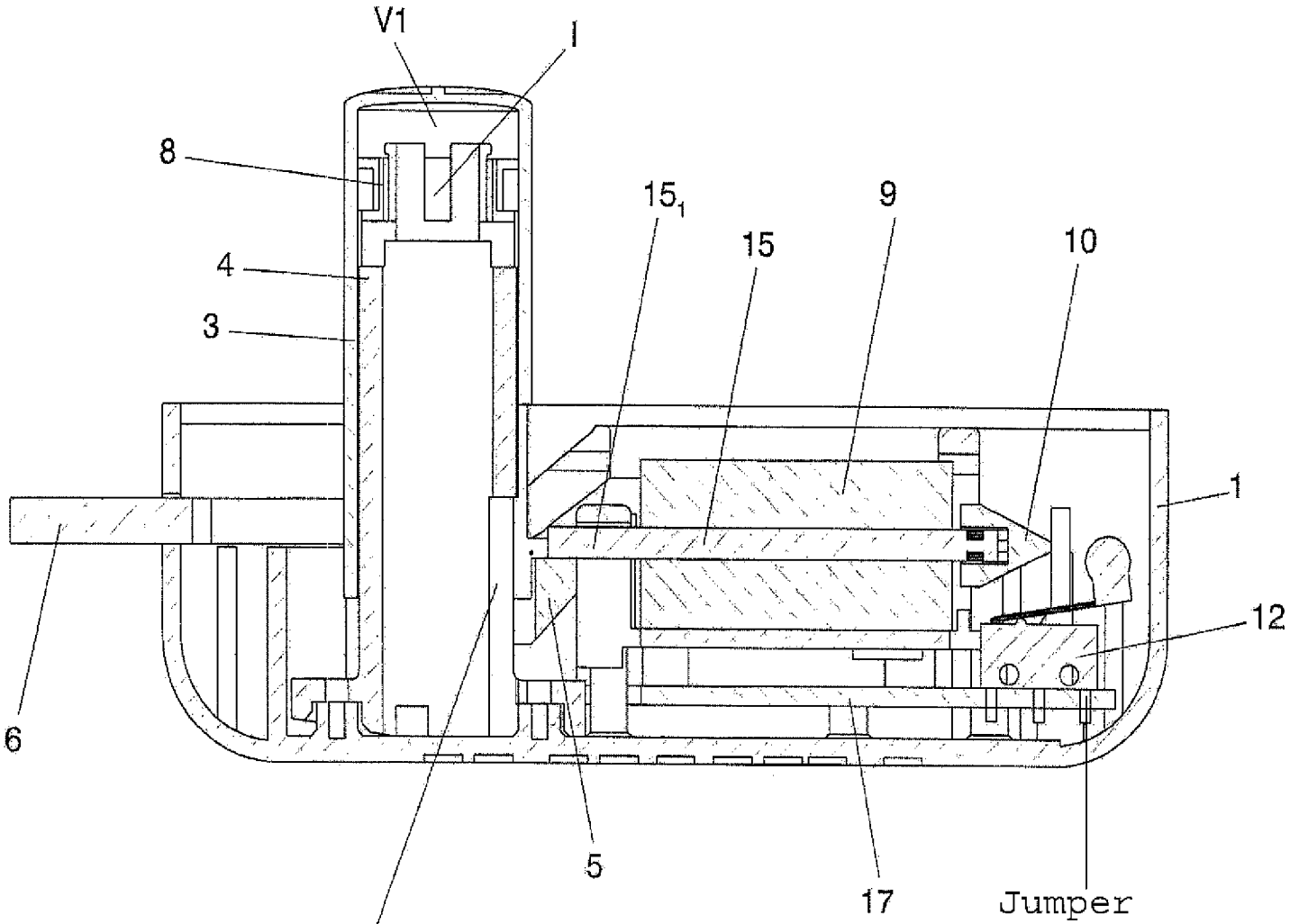
FIG. 3 is a view of FIG. 2 according to section A:A.
Figure 4:
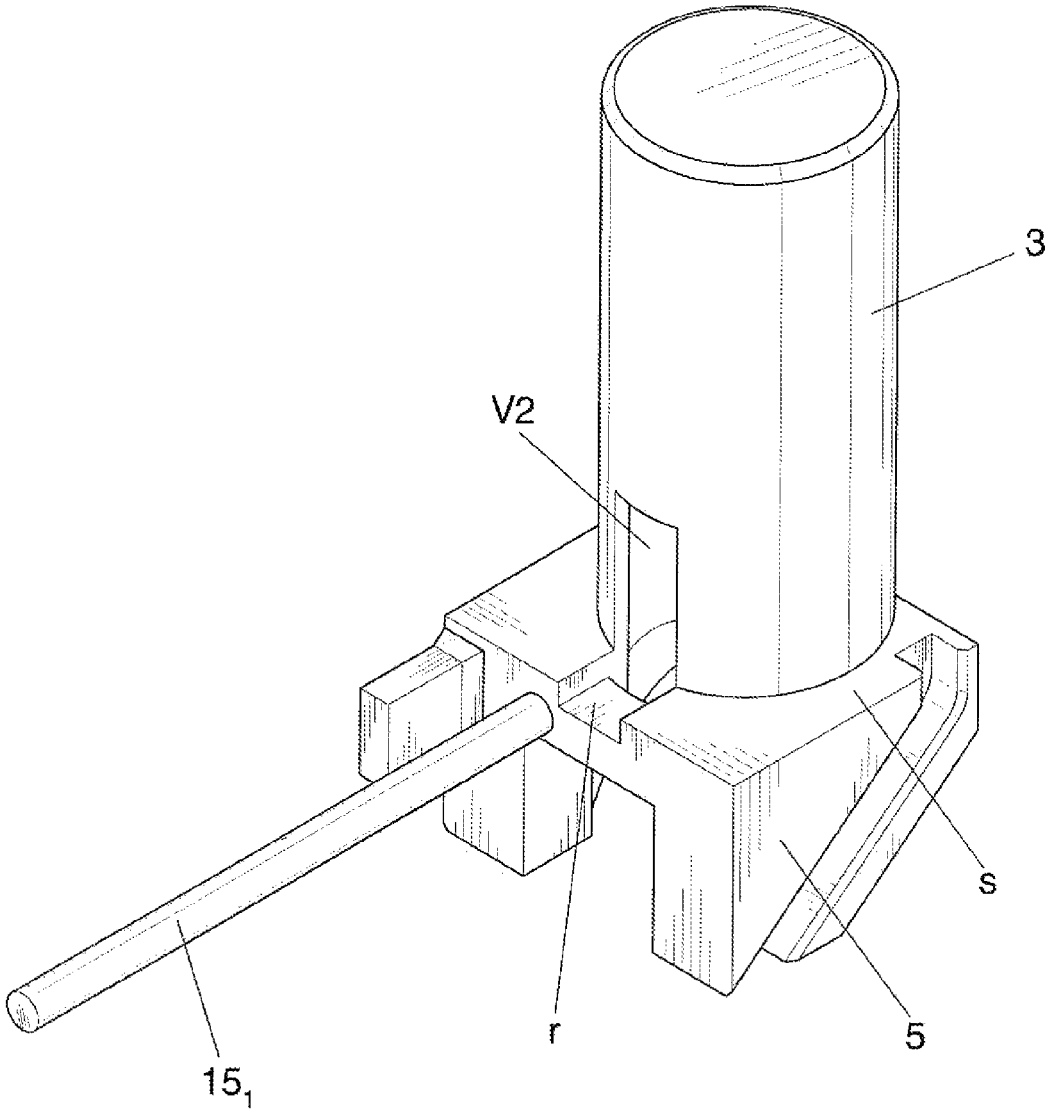
FIG. 4 is an exploded view of the arrangement of the mounting hole piece (5), end ($\mathbf{15}_1$) of the shaft (15), push button (3) with its second window ($V_2$).

In FIGS. 3 and 4 we can see that the solenoid (9) consists of a shaft (15) which, when activated, protrudes out the first end ($\mathbf{15}_1$) and positions itself upon the surface (s) of the push button/mounting hole piece (5) or in a recess (r) of it so that the entire knob block is locked in ascending direction.

It can also be seen that:

a) the turn knob (3) has a drillable area ($V_1$) at its top and a window ($V_2$) facing the first end ($\mathbf{15}_1$) of the shaft (15) of the solenoid (9), and b) the knob guide (4) has a window ($V_3$) facing the window ($V_2$) of the turn knob (3), so that with a tool it can be accessed from the drillable area ($V_1$) to the first end ($\mathbf{15}_1$) of the shaft (15) of the solenoid (9).

There are occasions (due to breakdown) in which the unlocking of the solenoid can only be done mechanically with access from the exterior.

The drillable area ($V_1$) is transparent and on the knob guide, (4) has a polychromatic led (l) controlled by the microcontroller (17), and which, in combination with pre-established times, indicates the state of the lock to the user.

The led (l) can be red/green/orange which in combination of times and pauses, for example, on (1 sec.) off (2 sec.) on (1 sec.) and in accordance with a pre-established logical table, indicates to the user the state of the lock in detail.

The following is an example of some of the status indications with the led:

It also has the advantage that the electronic board (7) has a jumper which makes the board compatible with two electronic

| Color | Times | Time | Description |
|---|---|---|---|
| A | 3 | 400 | Detection low battery. (less than 10 times) |
| V | 2 | 400 | Initialization with keys correct. |
| V | 3 | 400 | Communication with PP OK. |
| V | 2 | 400 | Key deletion OK. |
| R | 1 | 1000 | No. Key installation incorrect. |
| R | 2 | 400 | Error on occupying or liberating free key. |

technologies, with the selection of the appropriate jumper and the reprogramming of the operation of the electronic board (7) through a connection jack, which provides great versatility.

The antenna (8) can be conventional or in pcb (print circuit board).

The invention claimed is:

1. A programmable electronic lock comprising a case;

a knob guide having one end fixed inside the case and another end extend outside the case;

an antenna carried at the other end of the knob guide;

a coaxial spring mounted on the knob guide;

a knob mounted on the knob guide and moving up and down under the action of the spring, the knob having one end positioned in the case and another end at the other end of the knob guide;

a knob block permanently joined to the one end of the knob, the knob block having lateral guide slots and an upper surface;

a tongue block positioned in the case, the tongue block having pins that slide in the lateral guide slots such that up and down movement of the knob cause lateral movement of the tongue block;

an electronic board with a microcontroller positioned in the case for controlling the opening and closing of the lock, the electronic board with the microcontroller communicating with the antenna;

a bi-stable solenoid operated by the microcontroller, the solenoid having a shaft, and in an activated state, one end of the shaft is positioned on the upper surface of the knob block for impending upward movement of the knob and another end of the shaft presses a hold down element of a contact which indicates to the microcontroller the correct operation of the lock in accordance with programmed logic.

2. Programmable electronic lock, according to claim 1, wherein a) the knob has a drillable area at the other end of the knob and a window facing the one end of the shaft of the solenoid, and b) the knob guide has a window facing the window of the knob, so that with a tool the one end of the shaft of the solenoid can be accessed from the drillable area.

3. Programmable electronic lock, according to claim 2, wherein the drillable area is accessible and in the knob guide there is a polychromatic led controlled by the microcontroller and which in combination with pre-established times, indicates to the user the status of the lock.

4. Programmable electronic lock, according to claim 1, wherein the electronic board has a jumper.

* * * * *